United States Patent [19]

Cathcart, Sr. et al.

[11] Patent Number: 5,046,642

[45] Date of Patent: Sep. 10, 1991

[54] AUTOMATIC SPRING-LOADED TUCKPOINTING GUN

[75] Inventors: John C. Cathcart, Sr., Marissa; John Coke, Jr., Coulterville; Roland D. Young; Eugene K. Cathcart, Sr., both of Marissa, all of Ill.

[73] Assignee: Arthur Macke, Marissa, Ill.

[21] Appl. No.: 457,143

[22] Filed: Dec. 26, 1989

[51] Int. Cl.[5] ..... B67D 5/42

[52] U.S. Cl. ..... 222/153; 222/326; 222/340; 222/391; /

[58] Field of Search ..... 222/325, 326, 327, 336, 222/340, 389, 390, 391, 153; 401/193, 261

[56] References Cited

U.S. PATENT DOCUMENTS

| | | | |
|---|---|---|---|
| 2,617,560 | 11/1952 | Pietrzak | 222/340 |
| 3,481,510 | 5/1968 | Allen, Jr. | 222/79 |
| 3,568,892 | 3/1971 | Burk | 222/327 |
| 3,606,085 | 9/1971 | Spilman | 222/43 |
| 3,983,947 | 10/1976 | Wills et al. | 222/327 |
| 4,171,072 | 10/1979 | Davis, Jr. | 222/391 |
| 4,273,270 | 6/1981 | Kray | 222/327 |
| 4,570,832 | 2/1981 | Kroger | 222/389 |
| 4,615,469 | 10/1986 | Kishi | 222/327 |
| 4,669,636 | 6/1987 | Miiyata | 222/153 |
| 4,706,853 | 11/1987 | Stonesifier et al. | 222/391 |

*Primary Examiner*—Michael S. Huppert
*Assistant Examiner*—Philippe Derakshani
*Attorney, Agent, or Firm*—Don W. Weber

[57] ABSTRACT

A spring-loaded viscous-material dispensing gun is presented which has a front material receiving portion and a rear drive portion. The front of the gun is loaded with viscous material and snapped into place by means of a locking collar and pins. A spring-driven drive disc then forces the viscous material out the tapered nozzle of the front of the gun. Safety mechanisms are provided to insure that the spring-loaded drive device is locked in place when the front material receiving cylinder is removed. A number of front material receiving cylinders may accompany the rear drive unit so as to insure the continuous ability of the workman to apply caulk or other material during the job.

4 Claims, 2 Drawing Sheets

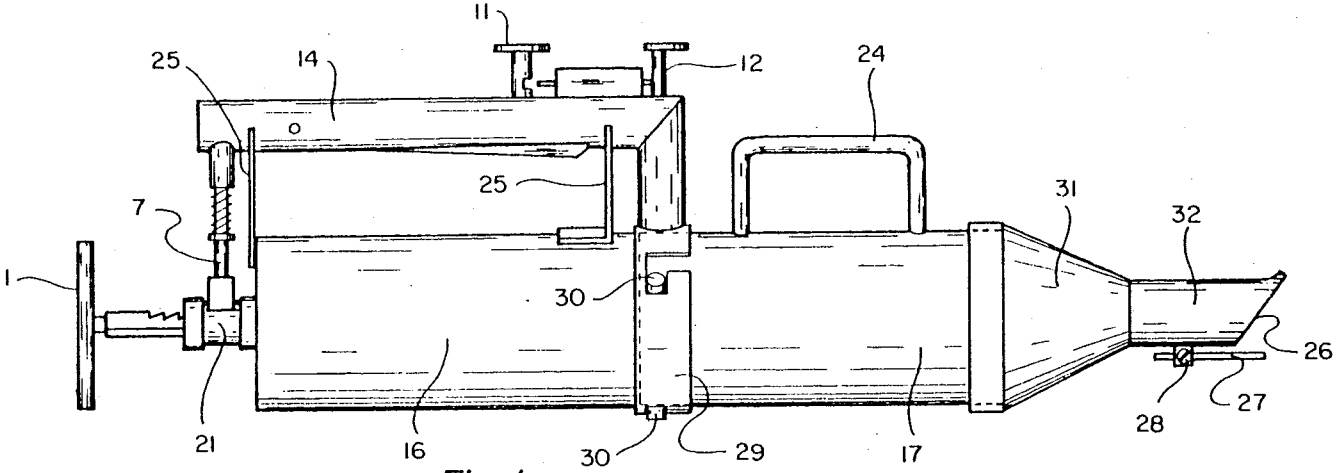
Fig. 1
Fig. 3
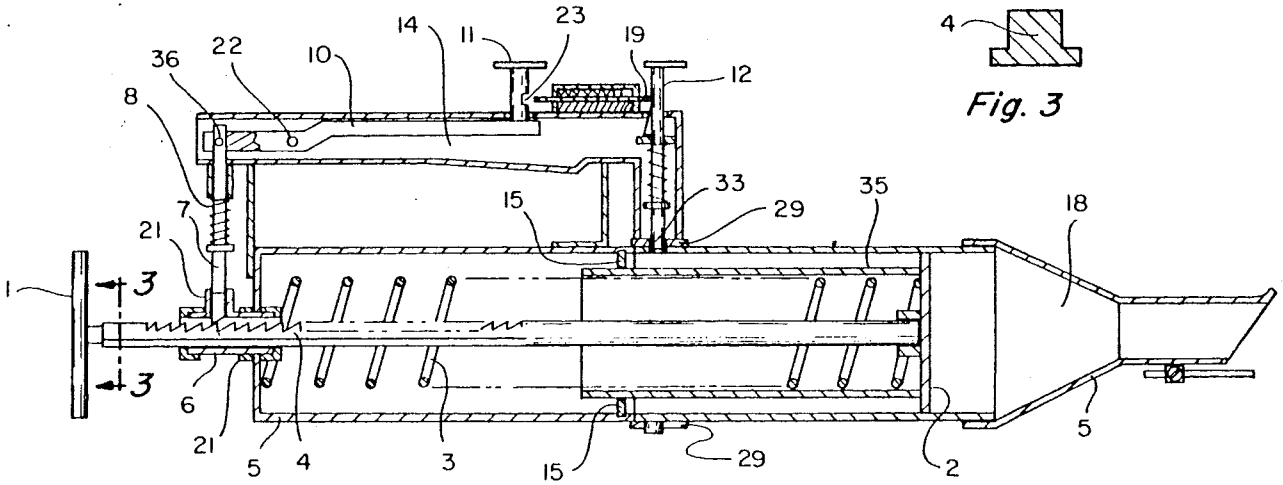
Fig. 2

AUTOMATIC SPRING-LOADED TUCKPOINTING GUN

BACKGROUND OF THE INVENTION

This invention relates to the field involving the application of caulk, cement or mortar. More particularly, it relates to a new type of dispensing gun which utilizes direct introduction of the material to be dispensed into the gun.

In the caulking or tuckpointing trade, the common method of dispensing the caulk or other material is to position a prepackaged tube of material into a caulking gun. The caulking gun then forces the material out the nozzle of the tube of caulk, thus dispensing the material. One problem frequently encountered in this dispensing operation is that the tube itself rotates. Rotating the tube changes the angle of declination of the point of the tube. It is highly desirable to keep the angle of declination of the point of the tube in a fixed position.

One method of keeping the angle of declination fixed is shown in the 1987 patent to Miiyata, U.S. Pat. No. 4,669,636. In that invention it was a primary object to provide a dispensing gun which is capable of adjusting the orientation of the angled edge at the nozzle of the disposable cartridge for effectively applying a smooth bead. It is an object of this invention to provide a dispensing gun which has a constant angle at the dispensing tip of the device.

Another object of this invention is to provide a dispensing gun into which caulk or other material may be directly introduced without the need for pre-packaging. Dispensing guns for dispensing viscous materials generally utilize a cartridge-type of system wherein the cartridge is prepackaged and sold in discreet amounts. While the cartridge system has certain advantages, it has substantial disadvantages in the commercial application. For example, the cartridges which are sold in discreet amounts are often quite expensive with respect to the job required. Additionally, the cartridge itself must be purchased in a set quantity and the packaging for the cartridge disposed of after use. Much waste ensues.

It is a further object of this invention to provide a dispensing gun for viscous materials which is reusable. It is also an object of this invention to provide a dispensing gun which may accept any amounts of viscous materials required by the particular job. It is a still further object of this invention to provide a dispensing gun with a number of individual front material receiving cylinders. Further and other objects of this invention will become apparent upon reading the following Specification.

BRIEF DESCRIPTION OF THE INVENTION

A spring-loaded viscous-material dispensing gun is presented which has a front material receiving portion and a rear drive portion. The front of the gun is loaded with viscous material and snapped into place by means of a locking collar and pins. A spring-driven drive disc then forces the viscous material out the tapered nozzle of the front of the gun. Safety mechanisms are provided to insure that the spring-loaded drive device is locked in place when the front material receiving cylinder is removed. A number of front material receiving cylinders may accompany the rear drive unit so as to insure the continuous ability of the workman to apply caulk or other material during the job.

BRIEF DESCRIPTION OF THE DRAWINGS

FIG. 1 is a side view of the caulking gun.

FIG. 2 is a side cut-away view of the caulking gun showing the internal mechanisms.

FIG. 3 is a cut-away cross-sectional view of the drive shaft.

DETAILED DESCRIPTION OF THE PREFERRED EMBODIMENT

Figure 4:
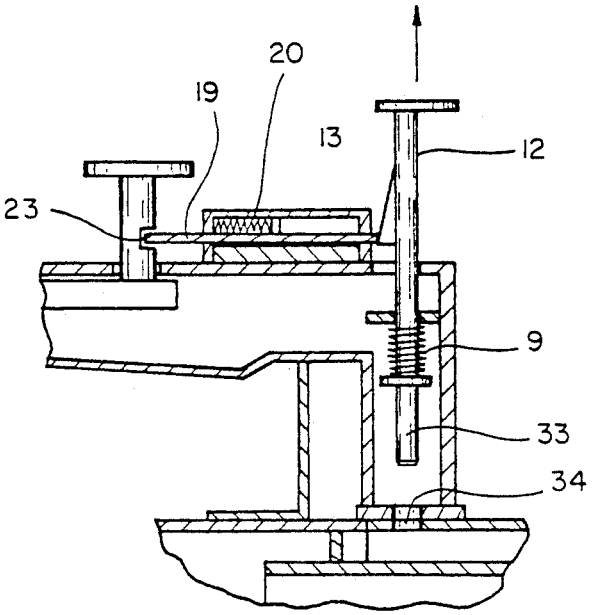
FIG. 4 is a detailed cut-away view of the trigger and safety pin mechanism.
Figure 5:
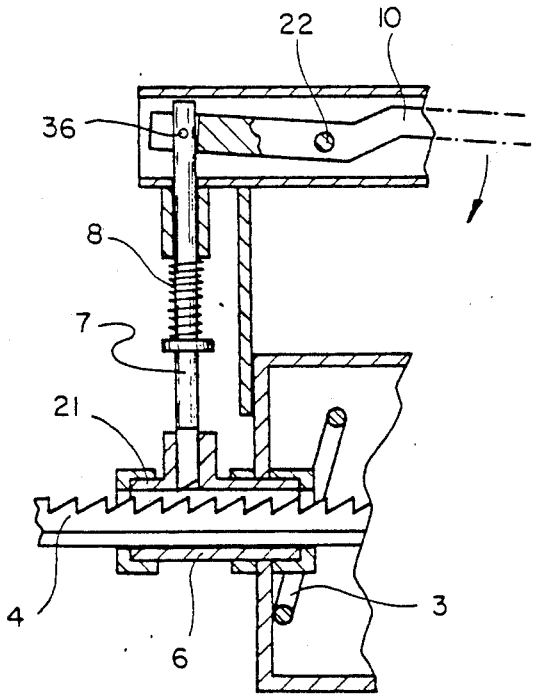
FIG. 5 is a detailed cross-sectional view showing the drive shaft releasing plunger.

The instant device is composed of essentially two main parts, a rear drive mechanism cylinder 16 and a front dispensing cylinder 17. The front dispensing cylinder 17 is detachable from the rear cylinder by means of the locking collar 29 on the rear cylinder. The front dispensing cylinder 17 has a number of corresponding locking pins 30 which enable a workman to quickly lock the front and rear pieces together. As shown on FIG. 1, the front dispensing cylinder has an essentially circular cross section but the front part of the front cylinder has a conical shape 31. The front conical portion 31 tapers into a small cylindrical nozzle 32. The small cylindrical nozzle is tapered at its point as shown at 26.

The internal mechanism of this device is best shown on FIG. 2. The internal driving mechanism of the device comprise a plunger handle 1. This handle 1 is connected to the drive disc 2 by means of a notched drive shaft 4. The drive disc has an inner stabilizing tube 35 attached in back of the disc.

The preferred embodiment drive means is a large helical drive spring 3. Although the particular size of the entire device may vary, the preferred length of the drive spring is approximately twenty-two inches with an outside diameter of two and seven-eights ($2\frac{7}{8}$) inches. A spring of this size will produce approximately twenty pounds of pressure on the drive disc 2. Although the device will function with between five and thirty pounds of pressure on the main drive spring, it has been found that the twenty-two inch spring described above produces the best results. The preferred drive spring will compress to approximately ten inches in length. The rear cylinder is ideally ten inches in length while the front cylinder is about eight inches. The inner stabilizing tube 35 is about eight inches in the preferred embodiment.

Both the front and rear cylinders are essentially cylindrical in nature. The front and rear cylinders may be made of hard plastic or of any other convenient type of metal, for example, aluminum, light-weight steel, or similar material. The outer casings 5 of the cylinders are arranged so that they lock together by means of a rear cylinder locking collar 29 and front cylinder locking pins 30.

The rear portion of the rear cylinder has a drive shaft aperture casing 21. The notched drive shaft 4 has a cross-section as best shown on FIG. 3. This notched drive shaft protrudes out of the aperture so that the handle 1 is available to cock the mechanism. The drive shaft is notched along the rear half of its length furthest from the drive disc. On the bottom of the drive shaft in the drive shaft aperture casing is a bushing 6.

Turning now to the trigger mechanism, a drive shaft releasing plunger 7 is spring-operated to control the movement of the drive shaft 4 and hence the drive disc 2. The lower portion of the drive shaft releasing plunger is tapered so as to compliment the notches on the drive shaft 4. The drive shaft releasing plunger 7 is biased downwardly by the drive shaft releasing plunger spring 8. The drive shaft releasing plunger thus normally operates to prohibit the drive shaft from driving the drive disc forward and extruding material out the front nozzle. However, when the workman pushes the notched trigger 11 downward, the pivotable trigger lever 10 pivots about the trigger lever pivot point 22. The trigger lever 10 is pivotably connected to the releasing plunger 7 by a pivot pin 36. This action in turn, raises the drive shaft releasing plunger and allows the drive shaft to push the drive disc forward, thus discharging viscous material out the front nozzle.

When the front and rear cylindrical portions are disconnected for recharging the viscous material, a danger arises in that this action could allow the main drive spring and drive shaft to move rapidly forward in an unexpected motion. To avoid this problem, a safety mechanism has been provided. As best shown on FIG. 4, this safety mechanism comprises a safety pin 12 which moves in a vertical direction. The safety pin 12 has a tapered shape 13. The safety pin 12 is biased downwardly by the safety pin spring 9. The lower portion 33 of the safety pin normally protrudes through both the front and rear outer casings 16 and 17 at casing hole 34. This locks the front and rear cylinders together. The locking collar 29 also helps secure the front and rear cylinder. The cylinders cannot rotate relative to each other with safety pin 12 in the down position. With the safety pin in the normally down position, as shown on FIG. 2, the taper 13 normally allows the sliding safety lock pin 19 to be biased away from the trigger locking notch 23, as shown on FIG. 2. However, when the safety pin is moved upwardly, the sliding safety lock pin 19 is forced to the left, against its spring bias, by the taper 13. Forcing the safety lock pin to the left into the trigger locking notch 23 locks the trigger in an "up" position. This, in turn, locks the drive shaft releasing plunger in a down position, locking the drive shaft 4. The combination of the trigger mechanism and safety lock pin mechanism will prevent the accidental disengagement of the mechanism and prevent the powerful drive spring from driving the drive shaft and disc in an outward direction with the front cylinder removed. The entire trigger and safety pin locking mechanism is located in a hollow rear upper handle 14.

To insure that the viscous material remains in the front cylinder and does not seep into the mechanism contained in the rear cylinder, and to stabilize the drive shaft as it moves forward, a protective 0-ring 15 is located near the junction of the front and rear cylinder. This 0-ring provides a seal between the disc and the outer portion of the front cylinder. The inner stabilizing tube 35 is in sealed contact with the 0-ring 15. As the drive shaft 4 moves forward toward the nozzle, the stabilizing tube 35 remains in sealed contact with the 0-ring. This not only seals out the viscous material from the drive spring, but also provides stability to the drive shaft 4.

The front dispensing cylinder has a front conical nozzle 18. The front cylinder 17 also has an upper front handle 24 shown on FIG. 1. Supporting struts 25 connect the hollow rear upper handle 14 to the main body of the rear driving mechanism 16. Near the tapered nozzle point 26 is an adjustable guide shaft 27. This adjustable guide shaft 27 allows the workman to position the mechanism in the appropriate position. The guide shaft 27 may be extended by loosening the guide shaft pin 28 and adjusting the length of the guide shaft.

In operation, the front dispensing cylinder 17 is filled with viscous material, which could be caulk, cement, or any other type of viscous material. The plunger handle 1 is then pulled out, thus compressing the drive spring 3 and moving the drive disc 2 towards the rear of the rear cylinder. The front dispensing cylinder 17 is then locked onto the rear drive mechanism cylinder 16 by means of the locking collar and pins and safety pin. As the trigger 11 is pushed down, the drive shaft releasing plunger releases discreet amounts of material by pushing the drive disc forward. The forward motion of the drive disc forces the material out the front tapered end 26.

It is within the contemplation of this invention that a number of front dispensing cylinders of similar shape and design may be used with a single rear drive mechanism cylinder. These front dispensing cylinders may each be loaded with material and supported on a rack in a vertical position. As the workman completes his job with a first front dispensing cylinder, a second dispensing cylinder may be readily attached by the previously disclosed method. Having a number of front dispensing cylinders available to the workman will greatly speed up the downtime for use of the mechanism.

This mechanism is ideally used for concrete mortar or grout and would save the workman much time and money by practicing this invention. The gun is ideally made of plastic or magnesium-aluminum allow or a similar material. However, the gun could easily be made smaller for use in ceramic or mosaic tile applications. A funnel and scoop can be used to load the mortar into the gun should a number of front dispensing cylinders not be available. In the preferred embodiment, three to five front dispensing cylinders per gun are required.

It is also within the contemplation of this invention that the drive mechanism could be an electric drive mechanism or air pressure. Should the electric drive or air pressure be utilized, the safety pin mechanism described herein would not be required since the electric drive or air pressure would be shut off by means of the trigger 11.

Having fully described my invention, I claim:

1. An automatic dispensing gun for cement or similar viscous material, comprising:

(a) at least one detachable front material receiving cylinder for receiving unpackaged viscous material having a front conical section and a tapered dispensing nozzle further comprising an adjustable guide shaft located near said nozzle, and having a rear cylindrical section wherein a plurality of locking pins are located;

(b) a rear drive mechanism cylinder detachably connected to said front cylinder by means of a front locking collar corresponding to said locking pins, said rear cylinder comprising an inverted T-shaped drive shaft which forces a drive disc forward, an O-ring seal to separate the driving mechanism from the viscous material, and a drive means connected to said shaft;

(c) a trigger means comprising a vertical drive shaft releasing plunger, a notched trigger and a pivoted lever connecting said plunger and trigger for releasing said drive means and forcing discreet amounts of material out of said front tapered nozzle; and (d) a safety means comprising a vertical safety pin having a tapered flange thereon wherein said safety pin protrudes through both the front and rear cylinder locking them together, and a sliding lock pin connecting said safety pin to said notched trigger;

whereby the drive means is locked in place when said front and rear cylinders are disengaged.

2. An automatic dispensing gun for cement or similar viscous material as in claim 1, wherein said drive mechanism comprises a spring.

3. An automatic dispensing gun for cement or similar viscous material as in claim 1, further comprising an inner stabilizing tube, surrounded circumferentially by said O-ring and connected between said drive means and said disc.

4. An automatic dispensing gun for cement, grout or similar viscous material, comprising:

(a) at least one detachable front material receiving cylinder for receiving unpackaged viscous material having a front conical section, a tapered nozzle and an adjustable guide shaft and a plurality of locking pins;

(b) a rear drive mechanism cylinder detachably and lockably connected to said front cylinder by a front locking collar corresponding to said locking pins and containing a drive means;

(c) a trigger means for actuating said drive means; and (d) a safety means comprising a vertical safety pin having a tapered flange thereon wherein said safety pin protrudes through both the front and rear cylinder locking them together, and a sliding lock pin connecting said safety pin to said notched trigger; whereby the drive means is locked in place when said front and rear cylinders are disengaged.

* * * * *